US005820444A

United States Patent [19]

McGaughey

[11] Patent Number: 5,820,444

[45] Date of Patent: Oct. 13, 1998

[54] POST SURGICAL BRASSIERE

[76] Inventor: Eleanor F. McGaughey, 151 Line Rd., West Chester, Pa. 19380

[21] Appl. No.: 792,060

[22] Filed: Feb. 3, 1997

[51] Int. Cl.[6] ..... A41C 3/12; A41C 3/02

[52] U.S. Cl. ..... 450/70; 450/41; 450/74; 450/80; 450/58; 2/73

[58] Field of Search ..... 450/8, 9, 19, 20, 450/21, 24, 30, 31, 32, 34, 35, 37, 53, 54, 55, 56, 57, 58, 59, 60, 61, 62, 74, 75, 76, 70, 79, 80, 82, 83, 84, 85; 2/73, 67

[56] References Cited

U.S. PATENT DOCUMENTS

| | | | |
|---|---|---|---|
| 1,576,393 | 3/1926 | Wood . | |
| 1,994,941 | 3/1935 | Caldor | 2/42 |
| 2,259,617 | 10/1941 | Clermont | 2/42 |
| 2,440,466 | 4/1948 | Freedman | 2/42 |
| 2,454,535 | 11/1948 | Warner | 450/57 |
| 2,562,582 | 7/1951 | Schaumer | 2/42 |
| 2,594,549 | 4/1952 | Flores et al. | 2/42 |
| 2,664,571 | 1/1954 | Kempel | 450/57 |
| 2,698,941 | 1/1955 | Melnyk | 2/42 |
| 2,703,885 | 3/1955 | Davis | 2/42 |
| 2,706,816 | 4/1955 | Dozier | 2/42 |
| 2,900,981 | 8/1959 | Herbener | 128/465 |
| 2,926,668 | 3/1960 | Schaumer | 128/465 |
| 3,040,750 | 6/1962 | Hurwitz | 128/482 |
| 3,077,197 | 2/1963 | Gerfinkel | 450/55 |
| 3,128,770 | 4/1964 | Laguzzi et al. | 128/484 |
| 3,433,229 | 3/1969 | Tuschman | 128/494 |
| 3,528,430 | 9/1970 | Child | 128/465 |
| 3,559,653 | 2/1971 | Jannicelli, Jr. | 450/76 |
| 3,566,878 | 3/1971 | Radomski | 450/74 |
| 3,620,222 | 11/1971 | Block | 450/57 |
| 3,665,929 | 5/1972 | Brantly | 128/494 |
| 3,709,230 | 1/1973 | Rich | 128/486 |
| 3,717,154 | 2/1973 | Spetalnik | 128/494 |
| 3,773,052 | 11/1973 | Belardinelli | 128/465 |
| 3,779,250 | 12/1973 | Radomski | 128/489 |
| 4,174,717 | 11/1979 | Schreiber et al. . | |
| 4,292,975 | 10/1981 | Champion et al. . | |
| 4,699,144 | 10/1987 | Sherwood | 450/54 |
| 5,116,278 | 5/1992 | Sroub et al. . | |
| 5,215,494 | 6/1993 | Flanagan . | |
| 5,395,280 | 3/1995 | Greenberg | 450/32 |

*Primary Examiner*—Jeanette E. Chapman
*Attorney, Agent, or Firm*—Robert B. Famiglio; Famiglio & Associates

[57] ABSTRACT

A post surgical brassiere characterized by a torso encircling support band modified to gently secure the brassiere to the torso with minimal discomfort. At least three vertical bones are integrated into the band at strategic locations about its circumference to divide the band into four separate regions. Two such regions lay situate around the back and sides of the wearer while the remaining two regions overly the wearer's front midriff area. Each region is elasticized, but with varying degrees of stretch ability. As the two opposite ends of the brassiere's adjustment straps are drawn together for fastening, the resulting stretch of the support band will occur predominantly in the back and side regions where tension against the wearer will be greatest, leaving the two frontal regions relatively loose fitting. The shape and tapering of each band region, the orientation of vertical and horizontal stretch properties of the band fabric relative to the anchoring ridge and the degree of elasticity of the anchoring ridge itself may each or in combination play a role in the provision of the more gentle support over surgically effected areas of the body. In addition to support band modifications, the subject post-surgical brassiere also includes front closure means to reduce the amount of arm movement necessary to put on and remove the garment, circumference adjustment means, and novel unilaterally or bilaterally integrated nipple prosthetics.

7 Claims, 3 Drawing Sheets

POST SURGICAL BRASSIERE

FIELD OF THE INVENTION

The subject invention relates generally to women's support garments and more particularly to a brassiere suitable for wear during the recovery stages of breast surgery and thereafter.

BACKGROUND OF THE INVENTION

Heretofore, a myriad of innovations in brassiere design have been both patented and commercialized, many having in common the sometimes mutually exclusive objectives of providing improved breast support, appearance and comfort. Some are adapted for the needs of women who engage in athletics or who require a bra suitable for wear with strapless, low back or backless apparel. Some are designed for the full figured woman or for less endowed women desiring to enhance their natural appearance. Still others are designed to reshape the breast in a manner believed to be fashionable for a respective time period. Despite the staggering number of brasserie designs available on the market and disclosed in the prior art, however, there is a shocking absence of support garments designed to meet the special needs of women who have undergone breast surgery.

The past two decades have brought with them an alarming rise in the incidence of breast cancer and a proportionate amount of medically recommended corrective surgeries. This same time period has also been visited by a rise in the number of women choosing to have implants for cosmetic purposes or breast reduction surgery for health reasons. Whether elected out of necessity or desire, women who have undergone autogenous breast reconstructive surgery require time for healing, wearing a support garment which may be worn with a minimum of discomfort during their recovery.

Post surgical condition may be attendant with limited range of arm movement, particularly when the surgery involved removal of pectoral muscle tissue or lymph nodes. Additionally, tenderness of the surgical site including, in some cases, the abdominal and midriff regions is common. Where the nipple has been compromised, there will also be a need for subsequent reconstruction or prosthetics for cosmetic reasons. While the fit and feel of the brassiere may never be more important and noticeable during the patient's period of recuperation, conventional brassieres often exacerbate rather than alleviate the discomfort and swelling of the chest and subjacent midriff areas. After surgery, the newly rearranged tissue is not controlled in its former natural state, instead tending to creep downward. The ordinary up and down movement of the midriff area, inherent in normal body usage, may produce a bulge below each new breast at its point of attachment to the rib cage. Moreover, they possess no features to compensate for the diminished arm movement of the wearer or the varying degree of swelling which may be experienced throughout the day. Simply stated, brassieres of the prior art are ill-suited for providing post-operative support and the industry has ignored the important needs of an increasing population of women.

To better understand the advantages of the subject invention, it is helpful to first understand the general construction of the conventional brassiere which may be characterized as having three main components. The first component is a pair of cloth cups designed to encircle or partially encircle the breast mass. The second component relates to some form of a support system to hold and lift the breasts by providing requisite force on the cloth cups via shoulder straps or otherwise. Bearing in mind that the distribution of weight of the breast rests primarily below the apex, it may be appreciated that most conventional bras are designed to force symmetrical distribution of the breast mass within the cups via the support system. To prevent the cups from sliding or "creeping" up over the breasts as a result of this upward force, the third component, a torso encircling band, is usually added. This band is secured to the bottom of each cup and serves to anchor the brassiere to the wearer's midriff region, allowing the bottom of the cups to remain situate along the line of breast attachment to the chest wall.

THE PRIOR ART

Maintaining the relative immobility of the midriff band about the wearer's torso with improved comfort has been the subject of many prior art references. U.S. Pat. No. 2,562,582 issued to Schaumer in 1947 teaches a modified band design consisting of a strip of fabric elasticized to stretch principally in the longitudinal direction and having portions cut away to receive the cups. The unique shape of the Schaumer design is intended to cause the brassiere to conform to the breasts, provide uplift and cause the breasts and the soft flesh adjacent the breasts to be housed within the respective cups. Much of the weight of the bust is supported by the disclosed midriff band.

In 1953, attention was once again drawn to the significance of the midriff band in U.S. Pat. No. 2,703,885 issued to Davis, but for a significantly different purpose than anchoring the brassiere to the rib cage. Rather, the objective of the Davis reference is to provide a midriff band capable of placing the diaphragm under restraint and for constricting the waist. Here, the midriff band is characterized by the inventor as a "waist pincher".

Over a decade later, U.S. Pat. No. 3,433,229 was issued to Tuschman in 1966 for a uniquely shaped midriff band which, when worn on the body, stretches predominantly in the horizontal direction, but when the brassiere is in a flat position, the major stretch directions differ. More specifically, the front portion of the band will still remain substantially horizontal while the rear portion stretches downwardly and rearwardly. By this construction the brassiere purportedly accommodates to changes in chest size and shape as the wearer breathes and moves about.

In 1972, U.S. Pat. No. 3,665,929 was issued to Brantly for a brassiere design primarily featuring a single elastic band extending entirely around the lower edge of the brassiere such that the entire lower portion of the brassiere snugly fits a wearer's body with lower portions of the breast cups being snugly retained in place. The Brantly midriff band has a rectangular or strip-like shape and is the classic anchoring type support band. Its simple configuration may be observed in several subsequent brassiere designs such as, for example, U.S. Pat. No. 3,717,154 issued to Spetalnik in 1973, U.S. Pat. No. 4,174,717 issued to Schreiber et al. in 1979 (an athletic brassiere), U.S. Pat. No. 4,292,975 issued to Champion et al. in 1981, U.S. Pat. No. 5,116,278 issued to Sroub et al. in 1992, and U.S. Pat. No. 5,215,494 issued to Flanagen in 1993. In each of these references, the band width is relatively uniform throughout its circumference and is elastic at least in the horizontal direction.

Despite the many variations in their design, conventional support bands are all constructed to firmly hold the brassiere to the rib cage bearing in mind the active lifestyle and normal scope of movement of the average wearer. None of the above references even contemplates, let alone compensates for, the restricted arm movement, swelling and tenderness of the surgical patient, and the downward creep problem that remains to be permanent after healing. Predictably, the above conventional support bands have been found by some reconstruction patients to overly constrict the underlying torso causing further discomfort to the already swollen and tender midriff area. Clearly a need exists for a post operative support band capable of providing adequate brassiere immobilization with a minimum of discomfort during recovery.

Additionally, even after the recovery period has passed, many women may require a prosthesis for the nipple region; said prosthesis typically being held in place by the bra cup. Conventional prosthetics are made of silicone or elastomeric ("rubber") materials and tend to feel cold and clammy, are capable of being punctured, must be cleaned separate from the brassiere and are expensive, ranging from $59 to $185 each, ($118 to $370 per pair). It would correspondingly be beneficial to provide a prosthesis that is comfortable to wear, of sound structural integrity, machine washable together with the brassiere and inexpensive to purchase. Although a variety of removable pads and inserts exist in the prior art, none are considered a nipple prosthesis or are permanently integrated with the bra and none provide the natural shape afforded by the subject improved design. U.S. Pat. No. 2,698,941 issued to Melnyk in 1955, teaches a brassiere having a removable pad to enhance the bustline. The pad is constructed of molded sponge rubber, must be washed separately, and is intended to cover the entire breast rather than just the nipple region. U.S. Pat. No. 2,440,466 issued to Freedman in 1948 shares similar construction and shortcomings.

The subject invention obviates many, if not all, of the problems and limitations of the above described prior art by providing a brassiere specifically adapted for use by the post surgical patient.

SUMMARY OF THE INVENTION

The subject invention more specifically relates to a brassiere having several features of value to the recovering and recovered autogenous breast reconstruction patient or patients recovering from other surgery in this area. The midriff support band gently secures the brassiere to the torso with minimal discomfort. The reduction in constriction may be attributed to the insertion of at least three vertical bones at strategic locations along the band's length, thus dividing the band into four separate regions. Two such regions lay situate around the back and sides of the wearer while the remaining two regions overly the wearer's front midriff area. Each region is elasticized. As the two opposite ends of the brassiere's adjustment straps are drawn together for fastening, the resulting stretch of the support band will occur predominantly in the back and side regions where tension will be greatest, leaving the two frontal regions relatively loose fitting. The shape and tapering of each band region, the orientation of vertical and horizontal stretch properties of the band fabric relative to the anchoring ridge (hereinafter defined) and the degree of elasticity of the anchoring ridge itself may each or in combination play a role in the provision of the more gentle support over surgically effected areas of the body. The downward creep under each new breast is eliminated and the midriff band may also be very comforting to women of heavier weights who suffer from midriff pinching when wearing bras of the prior art. This applicant is not certain how the intended result is achieved, only that it is. Structural characteristics and observations are, of course, described in detail infra.

In addition to support band modifications, the subject post-surgical brassiere also includes front closure means to reduce the amount of arm movement necessary to put on and remove the garment, circumference adjustment means, and novel unilaterally or bilaterally integrated nipple prosthetics.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods and systems for carrying out the several purposes of the present invention. For instance, the term "brassiere" is used throughout the specification, however, this term is used in a broad sense in that the invention is equally applicable to halters, swimming suits, and other women's garments. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is, therefore, a primary object of the subject invention to provide a new and improved brassiere design specially suited for the needs of breast surgery patients.

More specifically, a primary object of the invention is to provide a brassiere that is more comfortable to the wearer's midriff region through the employment of a novel support band design. It is a primary object of the subject post surgical brassiere to prevent the downward movement of new breast tissue below each new breast also through the use of the novel midriff band.

It is another primary object of the subject post surgical brassiere to provide tension adjustment means to compensate for varying degrees of swelling experienced by the patient throughout the day.

It is a further primary object to provide a brassiere having front closure means to limit the degree of arm movement necessary to put on and remove the bra.

It is also a primary object of the present invention to provide a brassiere with one or two integrally constructed nipple prostheses.

Still another object of the invention is to provide a post surgical brassiere with the above attributes and benefits that is of relatively simple design and therefore inexpensive to manufacture.

These together with other objects of the invention, along with the various features of novelty which characterize the invention, are pointed out with particularity in the claims annexed to and forming a part of this disclosure. For a better understanding of the invention, its advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DETAILED DESCRIPTION OF THE PREFERRED EMBODIMENT

Figure 1:
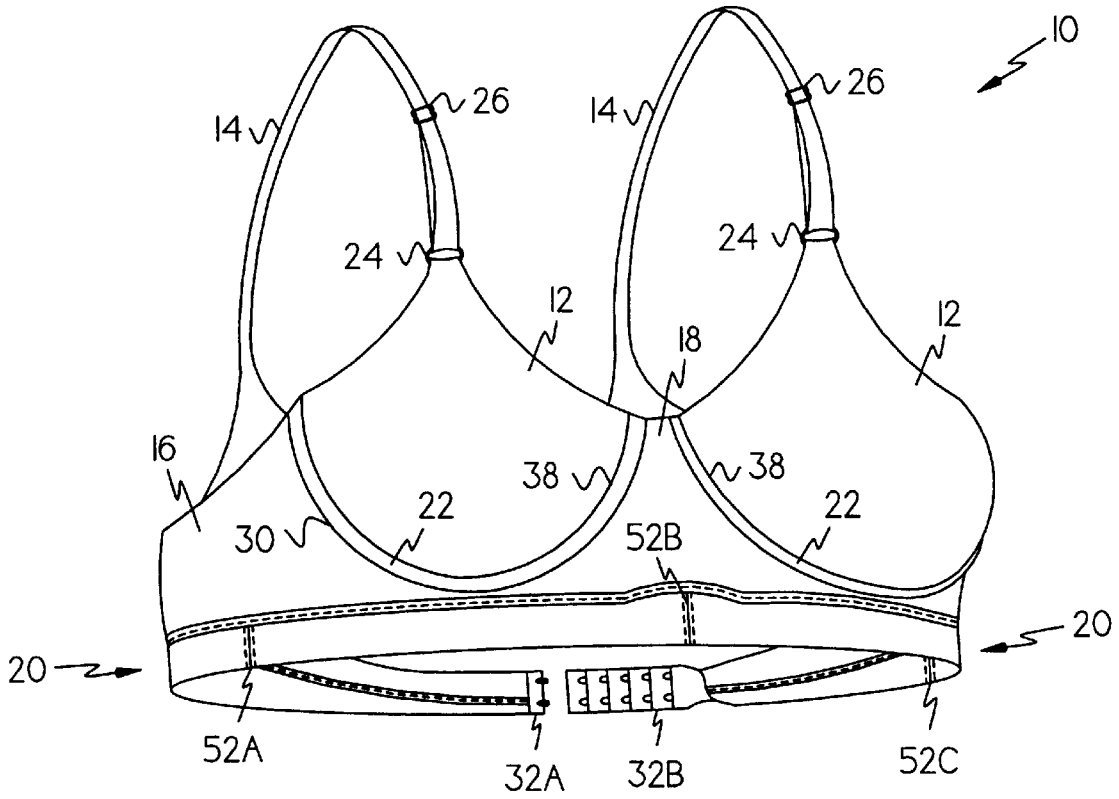
FIG. 1 is a perspective view of the subject post surgical brassiere.
Figure 2:
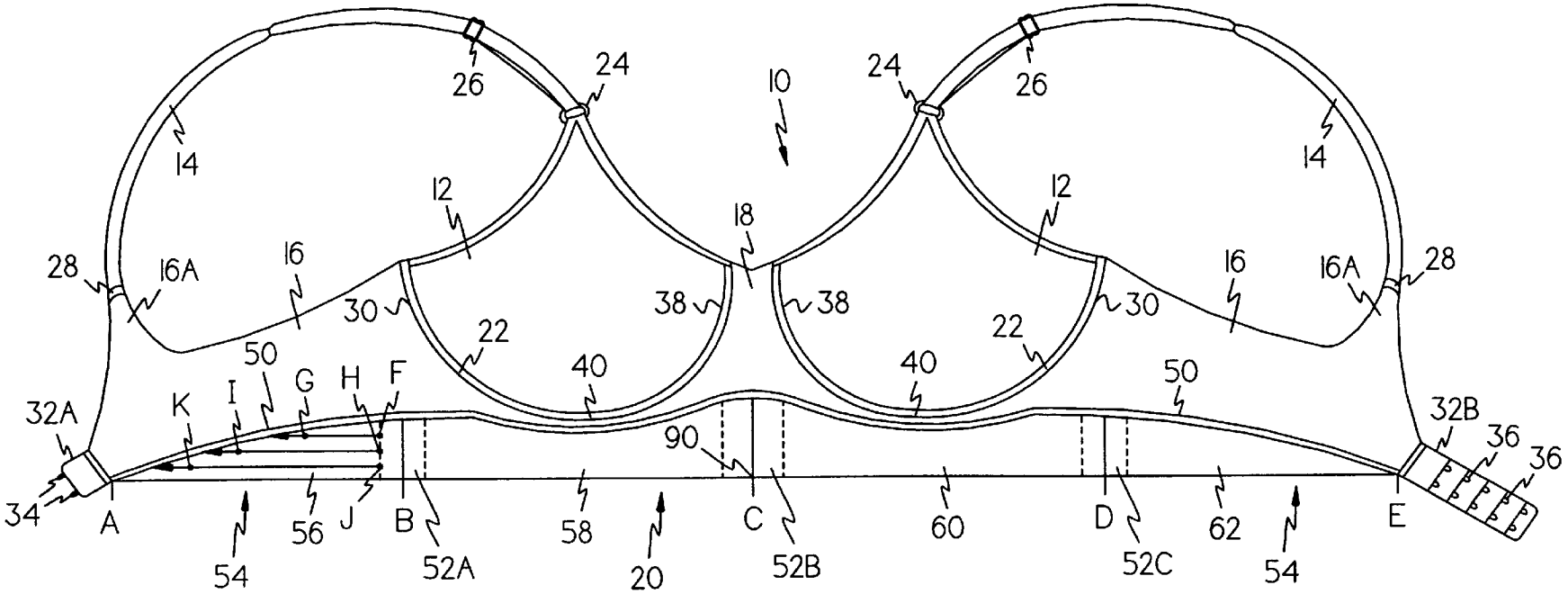
FIG. 2 is a front elevational view of the subject post surgical brassiere.

Reference is now made to FIGS. 1 and 2 in which there is illustrated in diagrammatic form the preferred embodiment of the subject post-surgical brassiere designated generally by reference numeral 10. Brassiere 10 has three major components: a pair of breast cups 12, a breast support system comprised generally of shoulder straps 14, two side panels 16 and center panel 18, and a midriff band 20. Cups 12 are of conventional conical shape being designed to encircle or partially encircle the breast mass and may be sized as needed to fit the wearer. Each cup 12 may be adapted with an underwire 22 to aid in the shaping of the new breast, however, inclusion of this feature should be postponed until receipt of physician approval. With the exception of the integral nipple prosthesis to be described later, the overall construction of cups 12 is unremarkable.

The shoulder straps 14 of the breast support system threaded through loops 24 which are fixedly attached to the uppermost portion of each cup 12. The opposite ends 28 (see FIG. 2) of each shoulder strap 14 are fixedly attached to their respective side panels 16 at terminal ends 16*a*. Requisite lifting force is applied to each cup 12 via shoulder straps 14. Force may be increased by shortening the length of each shoulder strap via vertical adjustment means 26 which are also of conventional design.

Side panels 16, also referred to as "wings", are constructed of elasticized material to further support the breasts by pulling the outer perimeter of cups 12 against the wearer's chest. It may be appreciated that the degree of force applied to each cup 12 in the lateral direction along each outer arcuate edge 30 is a function of the adjusted length of shoulder straps 14 as well as the attachment point of circumferential adjustment strap 32*a* on strap 32*b*. Note that strap 32*a* is adapted with at least two hooks 34 which are intended to be inserted into the desired pair of eyelets 36. Note too that several sets of eyelets 36 are available along the extended length of circumferential adjustment strap 32*b* to allow for at least a 5" adjustability of the bra about the torso. This is especially important during the first stages of recovery as swelling in the midriff area changes during the course of a day. Accommodating this need reduces pain. Note that this essential adjustment cannot be accomplished at the front closure without disturbing the integrity of the fit. Thus, the front closure bra will also require the extended back closure. Other suitable circumferential adjustment means may alternatively be employed.

Central panel 18 serves to connect in expandable fashion the inner arcuate edges 38 of each cup 12 to avoid undue separation of the breasts resulting from the above described lateral forces. For those embodiments of the subject invention having front closure means, central panel 18 will be necessarily split down its vertical axis with each resulting side being adapted with fastening means (not shown). A front closure is essential for some patients due to restricted range of arm motion inherent in the recovery process.

Anchoring ridge 50 serves as the boundary between midriff band 20 on the one hand, and circumferential adjustment straps 32*a* and 32*b*, side support panels 16, central support panel 18 and bottom arcuate edges 40 of cups 12 on the other. It is anchoring ridge 50 which traditionally lays against the point of attachment of the breast to the chest wall and, but for the anchoring effect of midriff band 20, would tend to slip over the bottom of the breasts in a creeping fashion.

Midriff support band 20 is constructed using spandex or other such four-way stretch fabric, together with one inch wide twill tape and three strips of sew-through polyester boning. The front closure model will require four bones rather than three, placing one on each side of the front hook and eye closure (not shown). The ends of these bones must be melted by heat to seal the ends before they are wrapped lengthwise in three inch strips of twill tape to form stays 52*a*, 52*b* and 52*c*. Alternatively, steel or plastic stays may be used.

Figure 3:
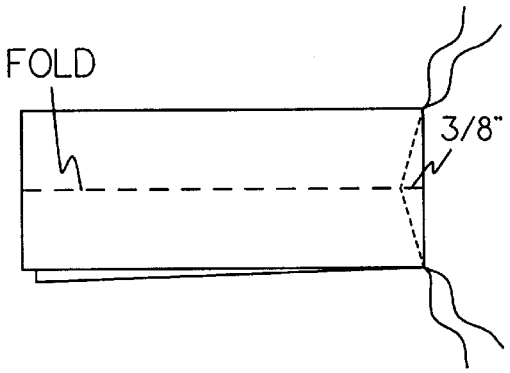
FIG. 3 is an illustration of a portion of the support band found in the non-front-closing embodiment of the subject invention.
Figure 4:
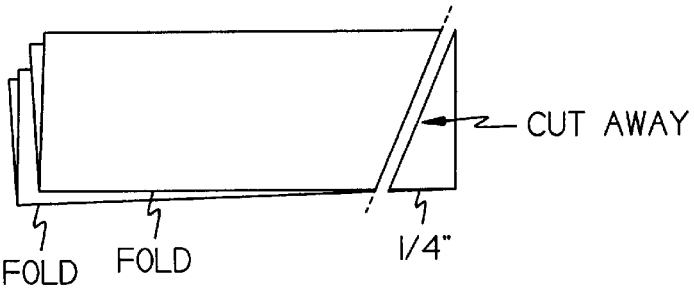
FIG. 4 is an illustration of a portion of the support band found in the front-closing embodiment of the subject invention.

The spandex midriff support band 20 is cut five inches wide. Its length is equal to that of anchoring ridge 50, minus an inch or so. Midriff band 20 is attached to the body of brassiere 10 which consists of side panels 16, cups 12, and central panel 18. At this point it should be recognized that when brassiere 10 is caused to lay flat such as in FIG. 2, the lower edge of its body as defined by anchoring ridge 50 forms a generally upside down V-shape. Each side support panel 16 extends diagonally from its neighboring cup 12 to its adjustment strap 32*a*, 32*b*. During construction, the top of midriff band 20 is cut away to follow the contours of anchoring ridge 50. Although less noticeable, midriff band 20 as a whole is also slightly tapered, its bottom edge 54 forming angle ace shown at 90 on FIG. 2. In the case of the no-front-closure model pictured, tapering of midriff band 20 is accomplished by folding the spandex along its center longitudinal axis and sewing a dart at the center front, beginning at nothing and going to about ⅜" at the middle point and returning to nothing as illustrated in FIG. 3. The front closure model will have this accomplished by simply folding and cutting the taper from each half as illustrated in FIG. 4.

Before the midriff support band 20 is folded over upon itself along its central longitudinal axis, the wrapped stays are laid in place on the outstretched top half of the band 20 and the bottom half is folded up such that the top edge of midriff band 20 is placed along anchoring ridge 50. The upper edge of midriff band 20 is then stretched slightly to equal the length of anchoring ridge 50, stitched thereto with a multiple zigzag stitch and allowed to relax to its original length. Recall that the length of midriff band 20 was slightly less than that of anchoring ridge 50. By connecting the two in this fashion, anchoring ridge 50 is attributed semi-elasticity, less stretchable than the overall body of brassiere 10 and support band 20, but capable of some movement. Each stay 52*a,* 52*b,* 52*c* is stitched to secure it in place within the folded midriff band 20 at the strategic locations illustrated. One such stay 52*b* will be located at the midpoint of midriff band 20 while the remaining two stays 52*a,* 52*c* are placed just outside of the outer arcuate edge 30 and slanted slightly to the back of each cup 12 such that when brassiere 10 is worn, stays 52*a* and 52*c* are vertically oriented under the arms of the wearer along the sides of her rib cage. This placement will vary slightly from bra to bra and the degree of tapering will depend upon the body build of the patient to an extent.

In operation, brassiere 10 is secured to the wearer by fastening of adjustment straps 32*a,* 32*b* with the degree of tightness desired by the patient controlled through the selection of different eyelet pairs 36 along the length of circumferential adjustment strap 32*b*. This must provide for at least 5" of additional hooks and eyes, depending on the overall give of the bra. The force used to create the desired tension and fit is transmitted principally through semi-elastic anchoring ridge 50 of side panels 16. However, force is also transmitted along the length of midriff band 20. It may be important to note at this point that the horizontal stretch capability of the spandex used in midriff band 20 is coaxially aligned with bottom edge 54. It is equally important to observe that stays 52*a,* 52*b,* 52*c* act to immobilize midriff band 20 in their respective locations, serving as vertical anchors for the horizontal stretch components of the spandex. Accordingly, the employment of stays 52*a,* 52*b,* 52*c* results in the creation of four separate midriff band regions 56, 58, 60 and 62. Relatively rectangular regions 58 and 60 overlay the tender and swollen midriff area of the patient, while triangular regions 56 and 62 overlay the less tender sides and back of the patient.

Due to the horizontal tapering effect of anchoring ridge 50 in triangular regions 56 or 62, any force applied to adjustment straps 32*a,* 32*b* and transmitted along anchoring ridge 50 will have a horizontal force component resulting in varying degrees of horizontal stretch of the spandex in these regions. For example, it may be appreciated that vector fg will have less stretch ability than vector hi which will have less stretch ability than vector jk. This force gradient is speculated to contribute to the overall comfort of the subject garment.

Of equal if not greater significance, however, is the observation that when force is applied to adjustment straps 32*a,* 32*b* and transmitted along anchoring ridge 50, it first causes horizontal stretch (and circumferential tightening) in regions 56 and 62 which, again, are along the back and sides of the patient. The patient feels the most pressure then in those areas which are unaffected by the surgery. This occupance is believed to result from the inclusion of the vertical anchoring capability of stays 52*a,* 52*b* and 52*c*. Once regions 56 and 62 have been caused to substantially reach their stretch limits, regions 58 and 60 will then begin stretching. The result is a gentle feel of the midriff support band around tender areas of the patient while still accomplishing the intended immobilization of anchoring ridge 50 in the desired location. The shape and tapering of each band region, the orientation of vertical and horizontal stretch properties of the band fabric relative to the anchoring ridge and the degree of elasticity of the anchoring ridge itself may each or in combination play a role in the provision of the more gentle support over surgically effected areas of the body.

Another important feature of the subject post surgical brassiere is the provision of both front and rear closure means. As mentioned, arm movement of the patient may be limited after surgery, making it more difficult to put on and remove the garment. Frontal closure means require less arm movement to access and, therefore, less pain. The patient will still require circumferential adjustment means to compensate for changes in swelling during wear. Said adjustment means are preferably located at the rear of the garment. While there are brassieres of record in the prior art having both front and rear closure means, none contemplate front closure means with rear adjustment means. In another embodiment of the invention, rear adjustment means are incapable of complete separation in an effort to maintain the "one-piece" character of the garment rather than two halves which may become separated during laundering for instance. For the front closure on the front closure/rear adjustment means embodiment, the central panel 18 must be cut apart as previously mentioned. The front is then completed by stitching a covered stay inside each front opening of the comfort band 20, stitching them in place and finishing the front from the bottom of the band up to the top of the center front of bra cups 12. A system using twill tape, hooks and eyes, and/or hook and eye tape similar materials necessary to a comfortable and easy closure. For example, tabs in the form of little bows may or may not be desirable—again depending upon variables in the individual situation.

Figure 5:
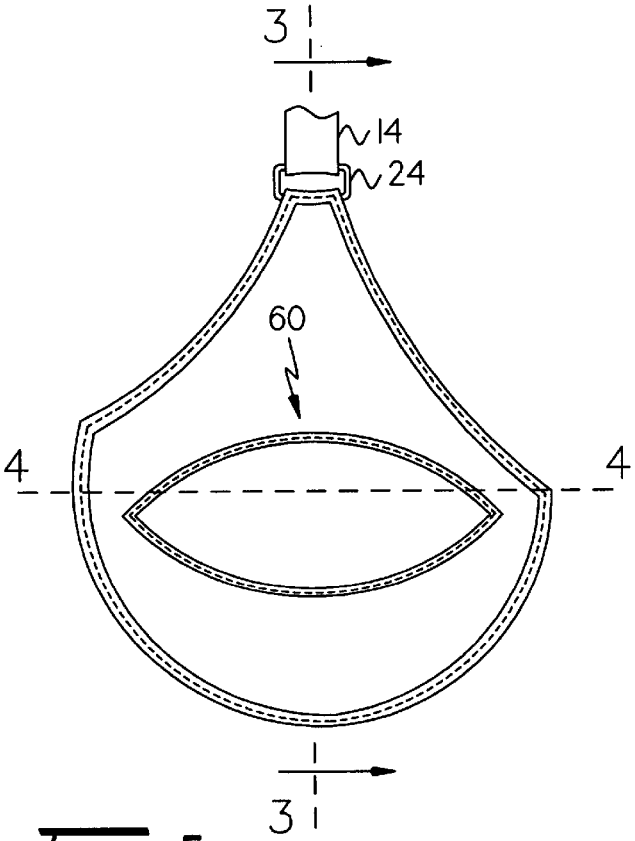
FIG. 5 is an elevational view of one cup of the subject invention, viewed from the interior thereof.
Figure 6:
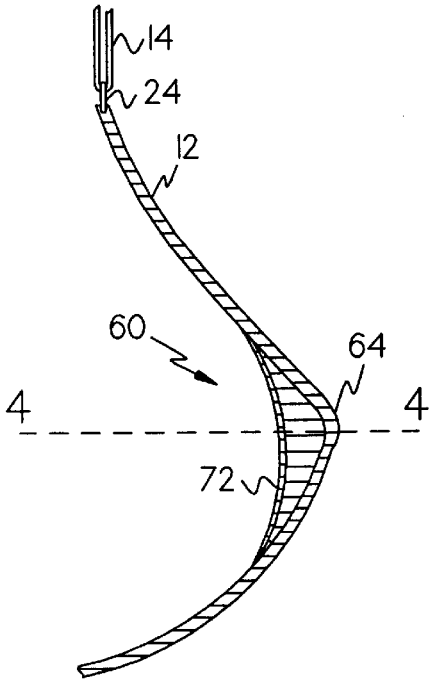
FIG. 6 is a cross-sectional elevational view taken along line 3—3 of FIG. 5.

Bearing in mind that flatness in the nipple area is the "normal" outcome of some reconstructions, a third and important feature of the subject post surgical support garment relates to the incorporation of a built-in nipple prostheses into one or both cups 12. Reference now being made to FIGS. 5 and 6, nipple prostheses 60 is comprised of interior panel 72 and polyester batting 64. Interior panel 62 is preferably constructed of a thin jersey fabric cut into an elliptical or lemon shape which has been found to produce a more natural look than a circular shape which tends to bind and wrinkle. Polyester batting 64 acts as a filler which may be cut and "sculpted" to lend the desired shape. Interior panel 62 is sewn using a multiple zigzag stitch to the back of the cup 12 such that the majority of the prosthesis 60 is located below the nipple line 4—4. This position has been found through experimentation to best erase any wrinkles that may form in the nipple area absent the subject prosthesis. This wrinkle, if left uncorrected, would spoil the fit of the outer garments. It has been found that centering of the prosthesis over nipple line 4—4 produces an unnatural appearance.

The above described features will be allowed or disallowed, according to the attending physician's advice, depending upon the stage of recovery and the individuality and desires of each woman. For example, a first stage bra to be used by the patient as a support for healing would probably incorporate only the gentle midriff and front closure features described, foregoing the use of an underwire support. The addition of a nipple prostheses may be elected before and soon after nipple reconstruction which will be a separate surgery after initial healing has occurred. Some women may choose to forego the added nipple reconstruction surgery with the availability of the prosthetic feature.

Although the present invention has been described with reference to the particular embodiments herein set forth, it is understood that the present disclosure has been made only by way of example and that numerous changes in details of construction may be resorted to without departing from the spirit and scope of the invention. Thus, the scope of the invention should not be limited by the foregoing specifications, but rather only by the scope of the claims appended hereto.

What is claimed as being new, useful and desired to be protected by Letters Patent of the United States is as follows:

1. A post-surgical brassiere specifically adapted for use by women recovering and recovered from breast reconstruction surgery, comprising:

(a) a pair of breast cups;

(b) a front panel connecting the inner arcuate edges of each breast cup;

(c) a pair of side panels connected to and extending outwardly and downwardly from the outer arcuate edges of said breast cups;

(d) rear closure means connected to the terminal end of said side panels for securing said terminal ends together about the wearer's body;

(e) a pair of support straps; one end of each support strap being connected to said pair of cups and the other end of each support strap being connected to said terminal end of said pair of side panels; and (f) a midriff support band for encircling the body of the wearer, and comprising left and right halves, each half thereof extending from the front center of the brassiere under its respective cup to said closure means; each half of said support band including:

(1) a top edge connected to and conforming with the shape of the bottom arcuate edge of its respective cup, the bottom edge of its respective side panel and the bottom edge of said front panel; and (2) a bottom edge having an upside down V-shape when the brassiere is laid flat; one end of said bottom edge being connected to the bottom edge of the other half of said support band, and the other end being connected to said terminal end of its respective side panel.

2. The invention of claim 1, wherein said support band has horizontal and vertical stretch components; said horizontal stretch component being in coaxial alignment with the bottom edge of each half of said support band.

3. The invention of claim 1, further comprising front closure means between said pair of breast cups.

4. The invention of claim 1, wherein said midriff support band is adapted with three stays: one located at the midpoint of said support band, and the remaining two located at points which relatively bisect each half of said support band; said stays structurally dividing said support band into four regions: two relatively rectangular regions, and two relatively triangular regions.

5. A post-surgical brassiere specifically adapted for use by women recovering and recovered from breast reconstruction surgery, comprising:

(a) a pair of breast cups; at least one breast cup adapted with a nipple prostheses comprising:

(1) an elliptically shaped interior panel; the perimeter of said interior panel being attached to the interior surface of said breast cup such that the majority of said interior panel is located below the nipple line of said breast cup; and (2) batting between said interior panel and said interior surface of said breast cup; said batting being sculpted to conform to the shape of a nipple;

(b) a front panel connecting the inner arcuate edges of each breast cup;

(c) a pair of side panels connected to and extending outwardly and downwardly from the outer arcuate edges of said breast cups;

(d) rear closure means connected to the terminal end of said side panels for securing said terminal ends together about the wearer's body; and (e) a pair of support straps; one end of each support strap being connected to said pair of cups and the other end of each support strap being connected to said terminal end of said pair of side panels.

6. The invention of claim 5, wherein said batting is constructed of polyester and said interior panel is constructed of a thin jersey fabric.

7. The invention of claim 1, wherein the rear closure means is further adapted with the adjustment means such that circumferential adjustment about the wearer's torso is possible.

* * * * *